United States Patent [19]

Ruskin

[11] 4,036,088

[45] July 19, 1977

[54] PAPER PUNCH WITH VARIABLE SPACING

[75] Inventor: Henry Ruskin, Cranford, N.J.

[73] Assignee: Rolodex Corporation, Secaucus, N.J.

[21] Appl. No.: 718,968

[22] Filed: Aug. 30, 1976

[51] Int. Cl.[2] ..... B26F 1/02

[52] U.S. Cl. ..... 83/167; 83/467 R; 83/571; 83/588; 83/618; 83/633; 83/698

[58] Field of Search ..... 83/167, 467, 468, 588, 83/618, 571, 633, 698

[56] References Cited

U.S. PATENT DOCUMENTS

| | | | |
|---|---|---|---|
| 2,244,660 | 6/1941 | Carpenter | 83/618 X |
| 3,362,271 | 1/1968 | Willis | 83/588 X |
| 3,387,526 | 6/1968 | Neilsen | 83/588 X |
| 3,446,105 | 5/1969 | Herzog | 83/588 X |
| 3,906,633 | 9/1975 | Inoue | 83/618 X |

*Primary Examiner*—Frank T. Yost

*Attorney, Agent, or Firm*—Robert E. Burns; Emmanuel J. Lobato; Bruce L. Adams

[57] ABSTRACT

Punching device for punching paper comprises a frame, a cooperating base supporting the frame, a plurality of individual punches removably and changeably mounted in the frame and an operating handle for actuating the punches. The frame is made of a single sheet of metal which is bent to form a U-shaped punch holding section comprising an upper portion, a lower portion and a portion connecting the upper and lower portions at one side and a die section which is joined with the lower portion of the punch holding section by a fold line and underlies such lower portion with an intervening space to receive the material to be punched. The upper portion and lower portion of the punch holding section have aligned bearing holes removably to receive and guide spring biased punches and the punching section has aligned punching holes to receive the lower ends of the punches when actuated by the operating handle. The base of the punch is formed of resilient plastic material and comprises a first portion closing the rear open side of the punch holding section of the frame, a second portion supporting the frame and a third portion which underlies the punching holes of the frame and provides a container in position to receive punchings. Flexible edge portions of the first portion of the base are engageable in annular recesses formed in the punches to provide means for removably retaining the punches in the holes of the frame in which they have been inserted.

20 Claims, 7 Drawing Figures

PAPER PUNCH WITH VARIABLE SPACING

FIELD OF THE INVENTION

The present invention relates to paper punches and particularly to punches which provide for selection of different spacings between the holes punched. While reference is herein made to punching paper, it will be understood that the punch is equally applicable to punching plastic or other sheet material.

BACKGROUND OF INVENTION

Paper punches are widely used for punching holes in paper to be used in ring binders or with various fastening devices used in assembling loose-leaf books or office files. As different numbers of holes and different hole spacing are required for different applications, punches have been provided with a plurality of spaced holes adapted to receive individual punching elements which are movable and interchangeable. By selecting the desired number of punching elements and placing them in suitably spaced holes of the punching device the desired number and spacing of holes can be punched in the paper.

While multiple punching devices of this kind are in general satisfactory, they have been found to be subject to various deficiencies and disadvantages. One difficulty has been in retaining the removable punching elements in the punch in such manner that they will not fall out when the punch is inverted but at the same time can be readily inserted and removed when desired. Another problem that has become more aggravated with increased material and manufacturing costs is that punches of this kind have become expensive to manufacture and hence must be sold at a high price.

SUMMARRY OF INVENTION

It is an object of the present invention to overcome the deficiencies and disadvantages of prior art punches and to provide an improved variable spacing paper punch. In accordance with the invention, the punch comprises a frame, a cooperative base supporting the frame, a plurality of individual punches removably and changeably mounted in the frame and an operating handle for actuating the punches. The frame comprises a single sheet of metal which is bent to form a punch holding section of U-cross section comprising an upper portion, a lower portion and a portion connecting the upper and lower portions and a die section which is joined with the lower portion of the punch holding section by a fold line and underlies the lower portion with an intervening space to receive the material to be punched. The upper and lower portions of the punch holding section have aligned bearing holes to receive and guide the punches while the die section has punching holes aligned with the bearing holes and adapted to receive the lower ends of the punches when actuated by the operating handle. The base is formed of resilient plastic material and comprises a first section which closes the open side of the punch holding section of the frame, a second section which supports the frame and a third section which underlies the die section of the frame and provides a container for receiving punchings. The first and second sections of the base are joined by a fold line of reduced thickness to facilitate bending the first section up to a position for closing the open side of the punch holding section of the frame while the second and third sections of the base are joined by a hinge line of reduced thickness to permit the third section to swing downwardly so as to open the container and permit emptying the punchings therefrom. A further feature of the invention is that flexible edge portions of the first section of the base engage in annular recesses provided in the individual punches so as to retain them removably in the frame while permitting easy insertion and withdrawal of the punches when it is desired to change the spacing or number of the holes to be punched.

DESCRIPTION OF DRAWINGS

The nature objects and advantages of the invention will be more fully understood from the following description of a preferred embodiment illustrated by way of example in the accompanying drawings in which.

DESCRIPTION OF PREFERRED EMBODIMENTS

Figure 5:
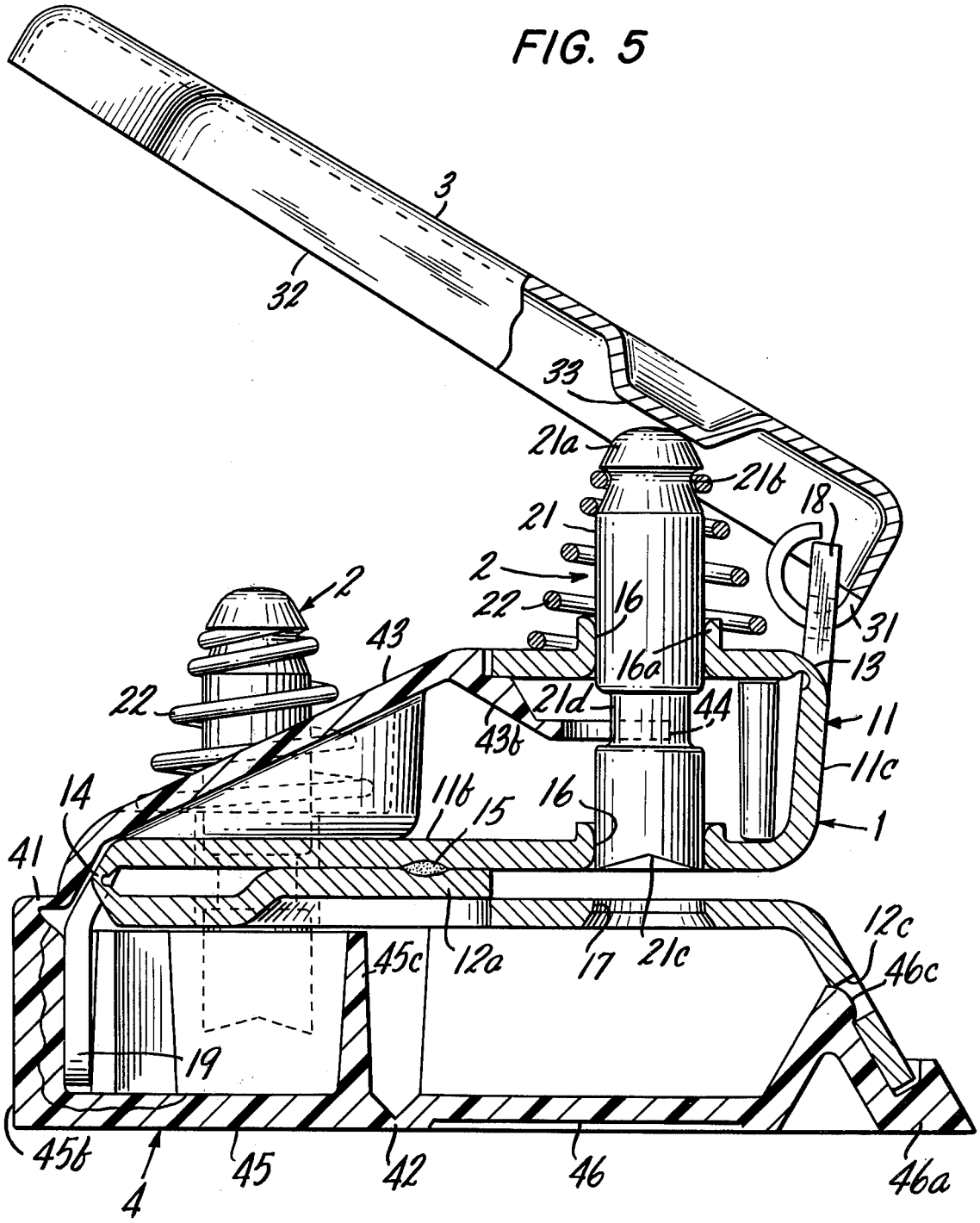
FIG. 5 is a cross section taken approximately on the line 5—5 in FIG. 1 but on a larger scale.

The punching device shown by way of example in the drawings comprises a frame 1, a plurality of punch assemblies 2, an operating handle 3 and a base 4. The frame 1 comprises a single sheet of metal which is shaped to form a punch holding section 11 and a die section 12. The punch holding section 11 is U-shaped in cross section with an uppe portion 11*a,* a lower portion 11*b* and a connecting portion 11*c.* As seen in FIG. 5 the upper portion 11*a* is approximately parallel to the lower portion 11*b* but is narrower. The connecting portion 11*c* is at the front of the punching device, the rear side of the punch holding section 11 of the frame being open. The bend line 13 between the upper portion 11*a* and the connecting portion 11*c* of the punch holding section of the frame is of reduced thickness as seen in FIG. 5 so as to facilitate bending of the metal to the configuration shown.

The die section 12 of the frame underlies the lower portion 11*b* of the die holding section 11 and is in part parallel to the portion 11*b.* The lower portion 11*b* of the punch holding section 11 and the die section 12 are joined by a fold line 14 which is of reduced thickness so as to facilitate bending the metal through approximately 180°. The forward portion of the die section 12 is spaced from the lower portion 11*b* of the die holding section 11 to provide a space S for receiving the paper or other material to be punched. Longitudinally spaced portions 11*a* of the die section 12 of the frame are partially severed and displaced upwardly into engagement with the lower surface of the lower portion 12*b* of the die holding section 11. The displaced portions 11*a* of the die section 12 are spot welded to the lower portion 11 of the punch holding section 11 as indicated at 15 to rigidify and strengthen the frame structure. Forward edges of the offset portions 12*a* provide abutments which limit the distance of the paper or other material to be punched can be inserted in the space S between the die section 12 and the punch holding section 11. A forward marginal portion 12*b* of the die section 12 is bent downwardly at an angle to the horizontal as seen in FIG. 5.

Figure 1:
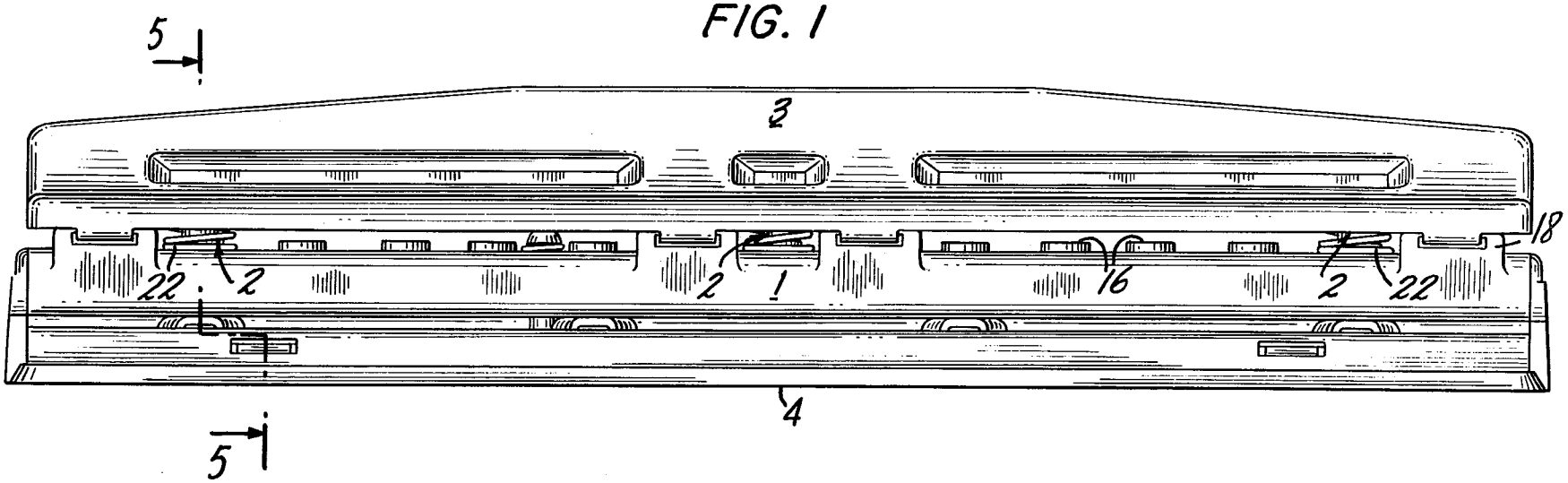
FIG. 1 is a front elevation of a preferred embodiment of a punch in accordance with the invention.
Figure 2:
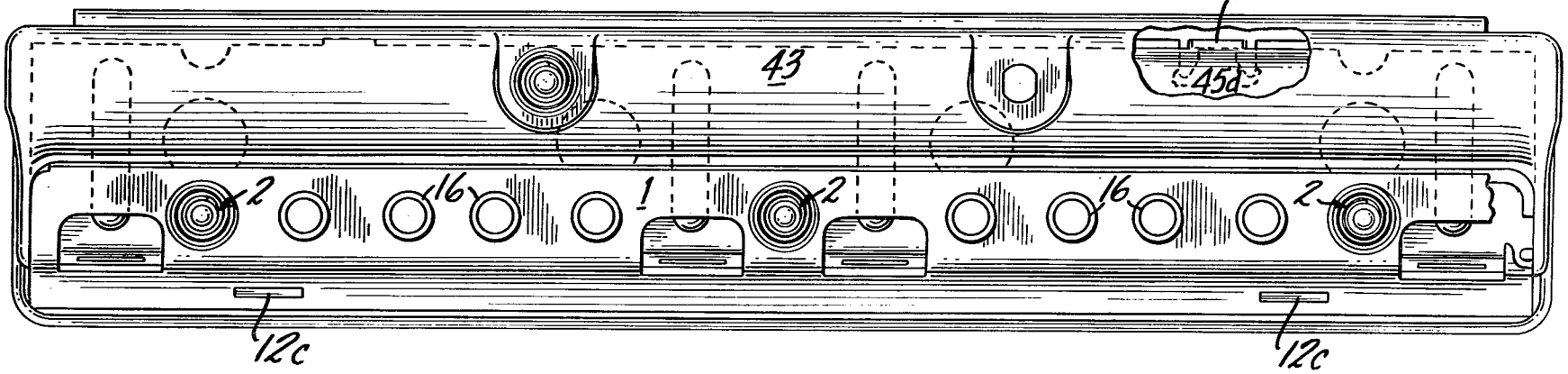
FIG. 2 is a plan view with the operating handle removed.

The upper and lower portions of the punch holding section 11 are provided with aligned bearing holes 16 to receive the punch assemblies. As seen in FIG. 2 there is a row of holes spaced from one another in a direction longitudinal of the frame. Each of the holes is surrounded by an upstanding collar 16*a* which provides a longer bearing surface for the punches. The die section 12 is provided with a corresponding number of punching holes 17 which are aligned with the respective bearing holes 16 of the punch holding section. As seen in FIG. 5 the punching holes 17 are flared downwardly so as to provide at the upper surface of the die section 12 shearing edges to facilitate a clean punching operation.

Each of the punch assemblies 2 comprises a punching rod 21 and a conically coiled spring 22. The punching rod 21 has a domed head 21*a* provided with an annular groove 21*b* in which seats the upper convolution of the coiled spring 22. This configuration permits assembly of the punching rod 21 and the spring 22 by pressing the spring down over the domer head of the punching rod whereupon the upper convolution of the spring snaps into the groove 21*b.* The punching rod and spring thereupon remain in assembled relationship. The punching rods 21 are of a diameter to be received with a snug but easily sliding fit in the bearing holes 16 of the frame. The lower convolution of the spring 22 seats on the upper surface of the punch holding section 11 and in relaxed condition as seen in FIG. 5 positions the punching rod with its lower end approximately flush or slightly above the lower surface of the lower portion 11*b* of the punch holding section 11. The lower end face 21*c* of the punching rod 21 is preferably shaped as a shallow V as seen in FIG. 5 to provide a better punching operation. The punching device as supplied to a customer includes a suitable number of punch assemblies, for example four or five, which can be placed in selected holes 16 of the frame according to the number and spacing of the holes it is desired to punch.

The operating handle 3 comprises an elongated lever wich extends substantially the full length of the punching device and is provided at its forward edge with spaced hool portions 31 which hook into slots provided in upstanding portions 18 of the frame to provide a fulcrum for the lever. The operating handle is formed of sheet metal, plastic or other suitable material. It is shown as being provided with a peripheral rim 32 and with downwardly projecting boss portions 33 which are adapted to engage the domed heads of punching rods 21 assembled in the frame. It will be seen that when downward pressure is exerted on the operating handle 3 so as to pivot it in a counter clockwise direction about its fulcrum, the portions 33 press on the punching rods 21 so as to move them downwardly from the position shown in FIG. 5 and thereby force the lower ends of the punching rods though the material to be punched ad into the holes 17 of the die section 12, thereby punching holes in said material. When the operating handle is thereafter released, the springs 22 return the punching rods and the operating handle to the positions shown in FIG. 5.

The base 4 is molded of resilient plastic material, for example polyurethane. It is divided by longitudinally extending hinge lines 41 and 42 of reduced thickness into three sections. An upper rear section 43 slopes upwardly and forwardly from the hinge line 14 and closes the otherwise open rear side of the punch holding section 11 of the frame. A shoulder 43*a* engages the rear edge of the upper portion 11a of the punch holding section 11. A further portion 43*b* slopes downwardly and forwardly from the shoulder 43*a* and is provided at its forward edge with a plurality of slooted fingers 44 wich are positioned to engage in annular recessed portions 21*d* provided in the punching rods 21 between the bearing holes 16 of the upper and lower portions 11*a* and 11*b* of the punch holding section 11. When punch assemblies are positioned in the frame as illustrated in FIG. 5, the slotted fingers 44 engage in the recessed portions 21*d* so as to retain the punch assemblies in the frame and prevent their falling out in the event the punching device is inverted. However, by reason of the resilience of the slotted fingers 44, the punch assemblies can be easily be inserted or removed manually from the frame. Moreover, the recessed portions 21*d* of the punching rods 21 are of sufficient axial length that the slotted fingers 44 do not in any way restrain axial movement of the punching rods during the punching operation and do not act as return springs. Return of the punching rods after a punching operation is effected solely by the conical springs 22.

Figure 3:
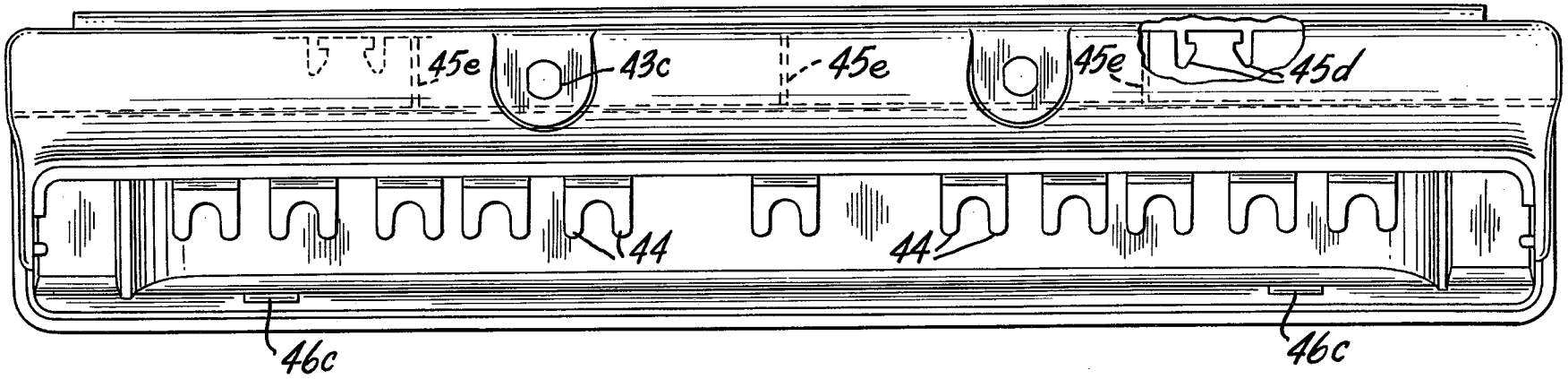
FIG. 3 is a plan view of the base.

The upper rear section 43 of the base is also provided with one or more recessed parking holes 43*c* two such holes being shown in FIG. 3. These parking holes are adapted to receive punch assemblies that are not presently being used for punching. The lower portion 11b and the die section 12 of the frame are provided with aligned holes to permit insertion of the parked punch assemblies as illustrated in FIG. 5.

A lower rear section 45 of the base is of upwardly opening U-shaped cross section comprising a bottom 45*a,* an upstanding rear portion 45*b* which joins the upper rear section 43 in the hinge line 41 and an upstanding forward portion 45*c* which extends up to and assists in supporting the die section 12 of the frame. The upstanding rear portion 45*b* is provided with two open molded slots 45*d* to receive lug portions 19 which are dependent from the rear portion of the frame to support the frame and provide attachment between the frame and the base. The lower rear section 45 is further provided with longitudinally spaced transverse wall portions 45*e* which extend between the rear portion 45*b* and forward portion 45*c* and provide further support for the frame.

The third section of the base floor is a front lower section 46 which extends forwardly from the section 45 and underlies the forward portion of the die section 12 of the frame. The section 46 thus underlies the punching holes 17 of the die section and provides a receptacle to receive the punchings. A forward portion 46*a* of the section 46 underlies the lower edge of the downwardly inclined forward portion 12*b* of the die section 12 and thereby supports the forward portion of the frame. Moreover the portion 46*a* of plastic material provides protection for a desk table or other surface on which the punching device is placed to prevent its being scratched or marred by the metal edge of the frame. Just rearwardly of the forward edge portion 46*a* the section 46 is provided with an upwardly projecting portion 46*b* of inverted V cross section which engages the inner surface of the downwardly inclined forward portion 12*b* of the die section 12. Small protuberances 46c on the upwardly projecting portions 46*b* are received in openings 12c in the downwardly sloping forward portion 12*b* of the die section 12 to retain the section 46 of the base normally in the closed position shown in FIG. 5. However, the section 46 can be swung downwardly about the flexible hinge 42 in order to open the receptacle formed by the section 46 in order to empty punchings therefrom.

Figure 4:
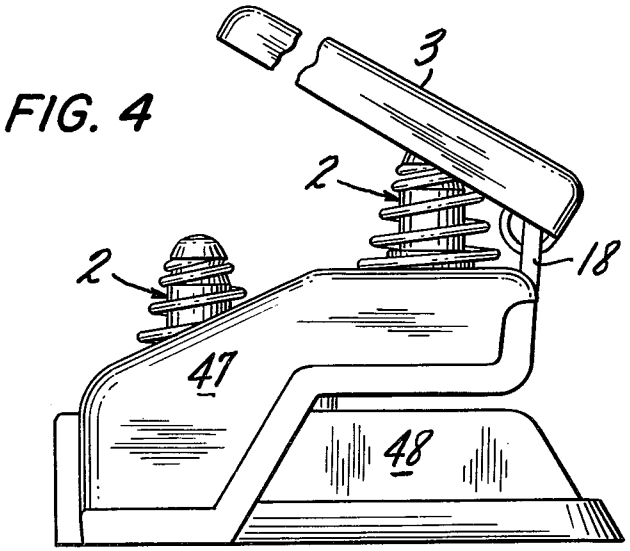
FIG. 4 is an end view of the punching device.

The molded plastic base 4 further has end portions 47 (FIG. 4) which close the otherwise open ends of the frame 1. Moreover, the lower front section 46 of the base has upwardly extending end portions 48 which form ends for the receptacle provided by the section 46.

By reason of the flexible hinge 41 the entire base can be easily molded of plastic material. When molded, the section 43 extends rearwardly from the section 45 and forms in effect a rearward continuation of the sections 45 and 46. After the base has been thus molded, the section 43 is bent upwardly and forwardly about the flexible hinge 41 to the position shown in FIG. 5.

Figure 7:
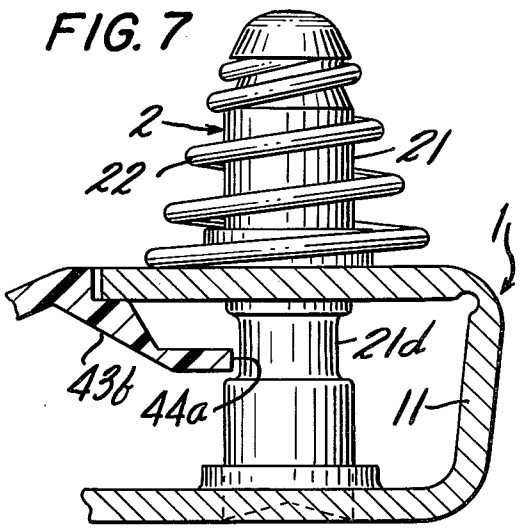
FIG. 6 is a fragmentary plan view of the base with one punch shown in section to illustrate a modification and FIG. 7 is a partial cross section taken approximately on the line 7—7 in FIG. 6.
Figure 6:
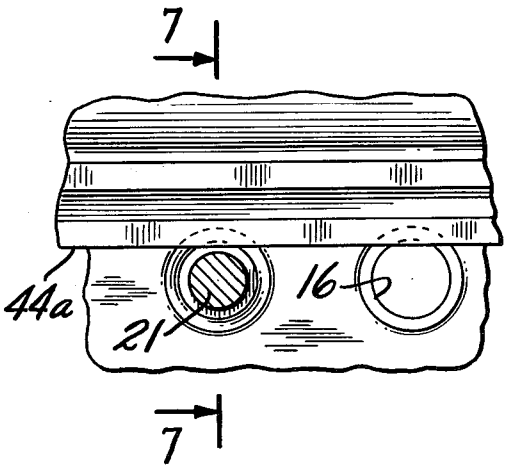

In FIGS. 6 and 7 there is shown a modification in which the forward portion 43*b* of the upper rear section 43 of the base is provided with a straight edge 44*a* instead of the fingers 44 shown in FIGs. 3 and 5. The edge 44*a* engages in the annular recess 21*d* of the punches 21 to retain the punch assemblies 2 removably in the punch holding section 11 of the frame 1. By reason of the flexibility of the material of the base, the punch assemblies can be readily inserted in and removed from the frame in order to change the number and spacing of holes to be punched. As in the case of the fingers 44 the flexible edge portion 44*a* of the modification shown in FIGS. 6 and 7 in no way interferes with movement of the punches during a punching operation and does not serve as a return spring, the return of the punches being effected by the conical springs 22.

While the preferred embodiment of the invention has been shown in the drawings and is herein particularly described it will be understood by those skilled in the art that many modifications can be made and that the invention is in no way limited to the illustrated embodiment.

What I claim is:

1. A punching device for punching paper and like sheet material comprising a frame, a cooperating base supporting said frame, individual punches removably and interchangeably mountable in said frame and an operating handle for actuating said punches, said frame comprising a single sheet of metal shaped to form a punch-holding section of U-cross section comprising an upper portion, a lower portion and a portion connecting said upper and lower portions at one side, the opposite side being open, and a die section joined with said lower portion by a fold line and underlying said lower portion with a space between said lower portion and said die section to receive the material to be punched, said upper portion and lower portion having aligned bearing holes to receive and guide said punches, and said die section having punching holes aligned with said bearing holes and adapted to receive the lower ends of said punches when actuated by said operating handle.

2. A punching device according to claim 1, in which said fold line joining said die section and said lower portion of said punch-holding section is of reduced thickness to facilitate bending said sheet metal approximately 180°at said fold line.

3. A punching device according to claim 1, in which portions of said die section spaced rearwardly from said punching holes are displaced upwardly from the plane of said die section into engagement with said lower portion of said punch-holding section to form stops limiting the insertion of the material to be punched into said space and are welded to said lower portion of said punch-holding section.

4. A punching device according to claim 1, in which said base is of resilient plastic material and comprises a first section closing the open side of said punch-holding section of said frame, a second section supporting said frame and a third section underlying said die section and providing a receptacle in position to receive punchings from said punching holes.

5. A punching device according to claim 4, in which said first and second sections of said base are joined by a flexible fold line of reduced thickness to facilitate bending said first section to a position for closing the open side of said punch-holding sections of said frame.

6. A punching device according to claim 4, in which said second and third sections of said base are joined by a flexible hinge line of reduced thickness to permit swinging down said third section to open said receptacle to permit emptying punchings therefrom.

7. A punching device according to claim 6, in which said die section of said frame has a downwardly bent forward edge portion and said third section of said base has a portion cooperating with said downwardly bent portion to support theforward portion of said frame and releasably to retain said third section in position to close said receptacle.

8. A punching device according to claim 4, in which said frame has open ends and in which said base has end portions closing said open ends of the frame.

9. A punching device according to claim 4, in which frame at the junction of said lower portion of said punch-holding section with said punch section has dependent lug portions and said second section of said base has molded sockets receiving said lug portions for attachment of said frame to said base.

10. A punching device for punching paper and like sheet material, comprising a plurality of individual punch assemblies, a frame having means for removably and interchangeably receiving a selected number of said punch assemblies with selected spacing between said punch assemblies and for guiding and supporting said punch assemblies for punching operation, a base of resilient plastic material supporting said frame, an operating handle for actuating said punch assemblies when in said frame and means integral with said base for removably retaining said punch assemblies in said frame to prevent accidental dislodgement of said punch assemblies from the frame.

11. A punching device according to claim 10, in which said frame has spaced-apart support portions having aligned bearing holes and said punch assemblies comprise punching rods slidably received in said bearing holes, and in which said retaining means comprises a portion of said base engageable with said punching rods between said support portions to retain said punching rods removably in said bearing holes.

12. A punching device according to claim 11, in which said punching rods have annular recesses between said support portions and said base has flexible resilient edge portions engageable in said annular recesses of said punching rods.

13. A punching device for punching paper and the like comprising a plurality of individual punch assemblies including punching rods, a frame for removably and interchangeably receiving a selected number of said punch assemblies with selected spacing between said punch assemblies and for guiding and supporting said punch assemblies for a punching operation, a base of resilient plastic material supporting said frame, and in an operating handle for actuating said punch assemblies when in said frame, said frame comprising a punch-holding section of U-cross section comprising an upper portion, a lower portion and a portion connecting said upper and lower portions at one side, the opposite side being open, and a die section underlying said lower portion with a space between said lower portion and said die section to receive the material to be punched, said upper and lower portions having aligned bearing holes to receive and guide said punching rods, and said die section having punching holes algined with said bearing holes and adapted to receive the lower ends of said punching rods when actuated by said operating handle, said plastic base comprising three integral sections joined with one another by flexible hinge lines, namely a first section closing the otherwise open side of said frame, a second section underlying and supporting a rear portion of said die section and a third section underlying a forward porton of said die section and comprising a receptacle to receive punchings, said third section being swingable about the flexible hinge line joining it with said second section to open said receptacle for emptying punchings therefrom.

14. A punching device according to claim 13, in which said frame has depending lug portions and said base has molded socket portions which receive said lug portions for attachment of said base to said frame.

15. A punching device according to claim 13, in which opposite ends of said frame are open and said plastic base portion comprises end portions closing the otherwise open ends of said frame.

16. A punching device according to claim 13, in which a flexible marginal portion of said first section of said base is engageable with said punching rods between said upper and lower portions of said frame removably to retain said punch assemblies from accidental dislodgement from said frame.

17. A punching device for punching paper and the like, comprising a plurality of like individual punch assemblies each comprising a punching rod and a spring secured thereto, a frame for removably and interchangeably receiving a selected number off said punch assemblies with selected spacing between said punch assemblies and for guiding and supporting said punch assemblies for a punching operation, a base for supporting said frame, an operating handle for actuating said punch assemblies when in said frame, said frame comprising a punch-holding section comprising an upper support portion, a lower support portion and a portion connecting said upper and lower support portions, said upper and lower support portions having aligned holes for slidably receiving said punching rods, each of said springs being conically wound with a smaller top convolution and a larger bottom convolution and each of said punching rods having a domed head with an annular groove in which the top convolution of the respective spring snaps to secure said spring in assembled relation with said punching rod and the bottom convolution being adapted to rest on said upper support portion of said frame, and means engageable with said punching rods between said upper and lower support portions of said frame to retain said punch assemblies on said frame to prevent their accidental dislodgement while permitting manual removal of said punch assemblies from said frame.

18. A punching device according to claim 17, in which said punching rods have annular recesses between said upper and lower support members of said frame, said retaining means comprises means yieldable engaging in said recesses.

19. A punching device according to claim 18, in which said retaining means comprises a resilient plastic member engageable in said recesses of said punching rods.

20. A punching device according to claim 19, in which said base is of resilient plastic material and said retaining means comprises a resilient edge portion of said base engageable in said recesses of said punching rods.

* * * * *